US005380010A

United States Patent [19]

Werner et al.

[11] Patent Number: 5,380,010

[45] Date of Patent: Jan. 10, 1995

[54] GOLF CLUB HEAD CONSTRUCTION

[75] Inventors: Frank D. Werner, Box SR9, Jackson, Wyo. 83001; Richard C. Greig, Jackson, Wyo.

[73] Assignee: Frank D. Werner, Teton Village, Wyo.

[21] Appl. No.: 144,676

[22] Filed: Oct. 28, 1993

[51] Int. Cl.[6] ..... A63B 53/04

[52] U.S. Cl. ..... 273/167 H

[58] Field of Search ..... 273/167 R, 167 H

[56] References Cited

U.S. PATENT DOCUMENTS

| | | | |
|---|---|---|---|
| 1,582,836 | 4/1926 | Link | 273/167 R |
| 1,968,092 | 7/1934 | Oldham | 273/77 |
| 2,171,383 | 8/1939 | Wettlaufer | 273/77 |
| 3,212,783 | 10/1965 | Bradley et al. | 273/171 |
| 3,847,399 | 11/1974 | Raymont | 273/167 F |
| 4,076,254 | 2/1978 | Nygren | 273/173 |
| 4,214,754 | 7/1980 | Zebelean | 273/167 H |
| 4,313,607 | 2/1982 | Thompson | 273/167 H |
| 4,417,731 | 11/1983 | Yamada | 273/167 H |
| 4,438,931 | 3/1984 | Motomiya | 273/167 H |
| 4,535,990 | 8/1985 | Yamada | 273/173 |
| 4,602,787 | 7/1986 | Sugioka et al. | 273/171 |
| 4,811,949 | 3/1989 | Kobayashi | 273/171 |
| 4,930,781 | 6/1990 | Allen | 273/167 F |
| 4,988,104 | 1/1991 | Shiotani et al. | 273/167 H |
| 5,060,951 | 10/1991 | Allen | 273/167 H |
| 5,106,094 | 4/1992 | Desbiolles et al. | 273/167 H |
| 5,163,682 | 11/1992 | Schmidt et al. | 273/167 J |
| 5,176,383 | 1/1993 | Duclos | 273/167 H |
| 5,213,328 | 5/1993 | Long et al. | 273/167 H |
| 5,288,070 | 2/1994 | Chen | 273/167 H X |
| 5,295,689 | 3/1994 | Lundberg | 273/167 H |
| 5,318,300 | 6/1994 | Schmidt et al. | 273/167 H X |
| 5,328,176 | 7/1994 | Lo | 273/167 H |

FOREIGN PATENT DOCUMENTS

| | | | |
|---|---|---|---|
| 664438 | 1/1952 | United Kingdom | 273/167 H |

*Primary Examiner*—William H. Grieb

*Attorney, Agent, or Firm*—Westman, Champlin & Kelly

[57] ABSTRACT

A golf club "wood" of hollow construction includes a shell or wall which is attached to the back side of the face plates and extends rearwardly to a mass mounted as part of the head. The shell or wall is relatively straight in the load bearing direction and is preferably corrugated to suppress buckling failure. The shell or wall may be cast, or if desired thinner sections may be made of sheet material and assembled to support the face by means of welding, silver brazing, or for certain materials, gluing in place. An outer cover may be added to preserve an approximately traditional external shape or to permit other freedom of design of the external shape. The cover is lightweight construction such as fiber-reinforced plastic, or a very rigid foam plastic material.

20 Claims, 4 Drawing Sheets

GOLF CLUB HEAD CONSTRUCTION

BACKGROUND OF THE INVENTION

The present invention relates to metal "wood" golf club heads and more particularly to a head construction which reduces deflection of the face plate during ball strike and increases the head and face plate rigidity for greater ball velocity.

Currently, most golf club heads of the type called "woods" are of hollow construction, some being fiber-reinforced plastic and most being cast of metal. In general, it is desirable to make these heads as large as practical, but this is limited because the walls tend to become too thin for manufacturing and the structure of the head becomes too fragile for the large momentary loads. In addition, greater structural rigidity of the club head increases the velocity of the ball.

Presently, metal wood heads are commonly cast, usually using stainless steel, with thin walls, a somewhat thicker face, and a large hole, usually in the bottom. A thin sole plate is welded into this hole to complete the structure of the cast metal wood head. These are generally called "metal woods". This invention is also applicable to "wood" club heads made of fiber-reinforced composite construction, but not to club heads made of solid construction such as wood or plastic and is equally applicable when the wood is fabricated as a hollow structure, using other materials such as graphite fiber-reinforced plastic.

Most heads of hollow construction are filled with foam. Such foam filling is of negligible structural importance and is of value for controlling the sound of impact, for making small final adjustments of head weight, and the like.

Metal wood heads are essentially a hollow structure with wall thickness of about 0.040 inch and face thickness of about 0.10 to 0.12 inch. The larger the volume of this structure, the greater the values of the mass moments of inertia about all axes of rotation. This decreases the detrimental effects on direction and distance for off-center hits. The maximum volume is limited because increasing the volume much beyond the usual amount requires an unacceptable increase in weight or else a thinner wall construction which becomes too fragile to survive the remarkably large impact forces or too thin for satisfactory casting.

During impact, the golf ball momentarily flattens against the club face, forming a circular contact area having a diameter of about three fourths of an inch. The surface of the club head also deflects but much less because the head is always made of much more rigid construction than the ball. Energy is required to deform the ball and the club head. If this energy of deformation (potential energy) is not completely transferred back to velocity energy (kinetic energy) during the impact, the ball will leave the club with correspondingly reduced velocity. A more rigid construction of the club reduces this problem because it deforms less and stores less potential energy. If it were perfectly rigid and did not deform, the problem would be eliminated so far as the club head is concerned. Deformation of the ball is, of course, a different and separate problem from club head design.

The problem of rigidity of the golf club head has been recognized in the prior art and attempts have been made to increase the rigidity without greatly affecting the weight of the club head. For example U.S. Pat. No. 4,076,254 to Nygren discloses corrugated metal ribs on plates 28 that extend from the rear of the face plate rearwardly to a weight. These plates are secured to the face plate with a suitable adhesive and are in a central area of the face plate and while the plates extend fore and aft (toe to heel) a substantial amount, the uppers edges of the face plate are not supported and an off center shot in up and down direction will cause substantial deformation of the club face plate.

United Kingdom patent 664,438 also discloses a strut extending between a front striking face and a rear wall, which is relatively straight in load bearing direction. The strut is described as being approximately one-half the width of the face plate and positioned centrally. The strut is smaller adjacent the face plate and expands out in rearward direction.

U.S. Pat. Nos. 4,930,781 and 4,988,104 have corrugated structures that bear on the center portions of the face plate but do not have the rigidity enhancing construction of the present invention.

An internal structure of honeycomb is used to support the face in U.S. Pat. No. 4,930,781 and also in U.S. Pat. Nos. to Raymont 3,847,399, and Allen 5,060,951. These are a departure for hollow woods from the usual structure in which the curved outer shell supports most of the load. In no case, do these internal structures extend from the face all the way to such mass as may be concentrated at the rear of the head. Also, none of these designs completely replaces the curved outer shell for structural purposes.

Two other U.S. Pat. Nos., Thompson 4,313,607 and Kobayashi No. 4,811,949 show one or more internal bracing structures which reach from the face to the rear of the outer curved shell. They do not show a suitable internal brace which can completely replace the structural features of the outer curved shell.

Desboilles et al., U.S. Pat. No. 5,106,094 shows internal support structure and other unusual features which are of general interest but have little relation to the present invention.

Prior clubs do have outer shells that attach directly to the face plate edges, as shown in U.S. Pat. No. 4,438,931 but these shells are not designed to carry the load without substantial deflection.

SUMMARY OF THE INVENTION

The present invention relates to a structural configuration and manufacturing and assembly method for golf club woods which are of hollow construction such as those cast in the form of thin-walled metal shells with a thickened and nearly flat plate having a striking face. The normal structural walls which are curved in all directions and which support the face are replaced with a structural shell which is substantially straight in the load bearing direction under ball impact and preferably is corrugated to suppress buckling failure. Although corrugation is preferred, it is a complication in manufacture. A simpler shape is generally satisfactory in which the shell is straight in the load bearing and merely curved rather than corrugated in the transverse direction. The structure is more rigid for the typical loads applied by ball impact on the face so that less energy is lost to structural deformation of the head during impact. The difficulty of manufacturing thin walls is avoided because the walls in the design of the present invention may be made of sheet metal and welded or brazed into place.

If the face is made of fiber-reinforced plastic, the shell may be made of similar material and is glued in place. It is possible to form the present structure as part of the face so as to minimize joining operations. As an option, an outer plastic shell may be used, which covers the unusual internal shape and thus gives a more conventional external shape.

The term rigidity is not at all the same as hardness or strength. Rigidity refers to structural stiffness. A club head could be made of harder material in such a way as to deform more readily. It could also be made to have greater strength (resistance to permanent deformation) and be less rigid.

The present structural shell may be designed to weigh less than the conventional curved shell construction. The mass thus saved in the shell may advantageously be placed elsewhere, such as toward the extreme rear end of the club head. This increases the most important moments of inertia. In turn, this causes the sweet spot to be larger, which means the club is more tolerant of off-center hits.

The present invention is not limited by thin structural walls and gives greater strength and stiffness (rigidity).

DETAILED DESCRIPTION OF THE PREFERRED EMBODIMENTS

Figure 1:
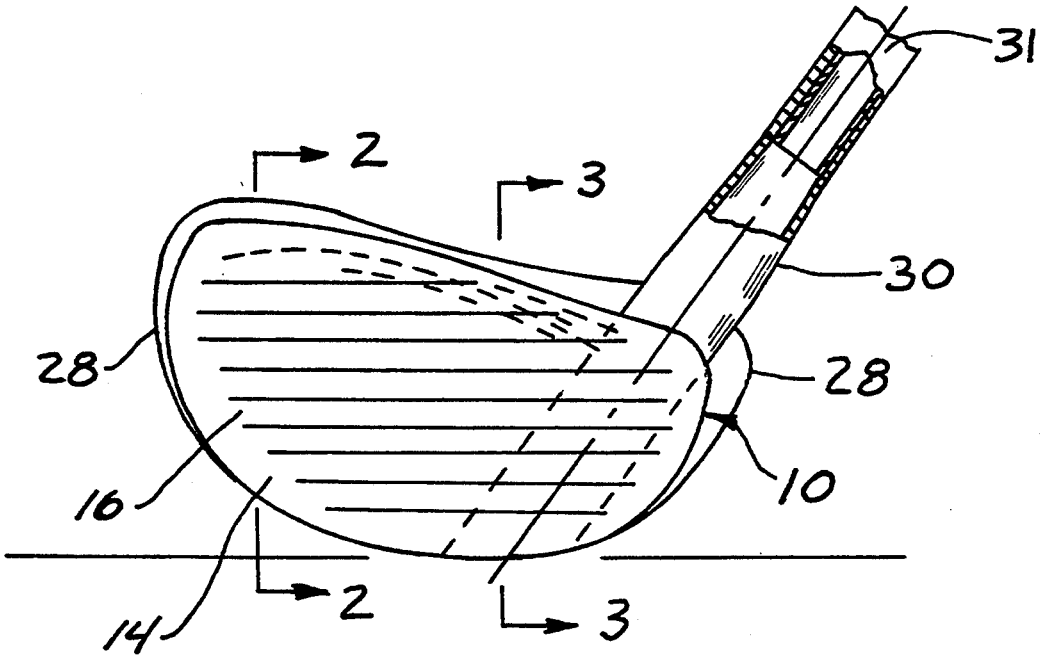
FIG. 1 is a front view of a golf club head embodying the present invention.
Figure 2:
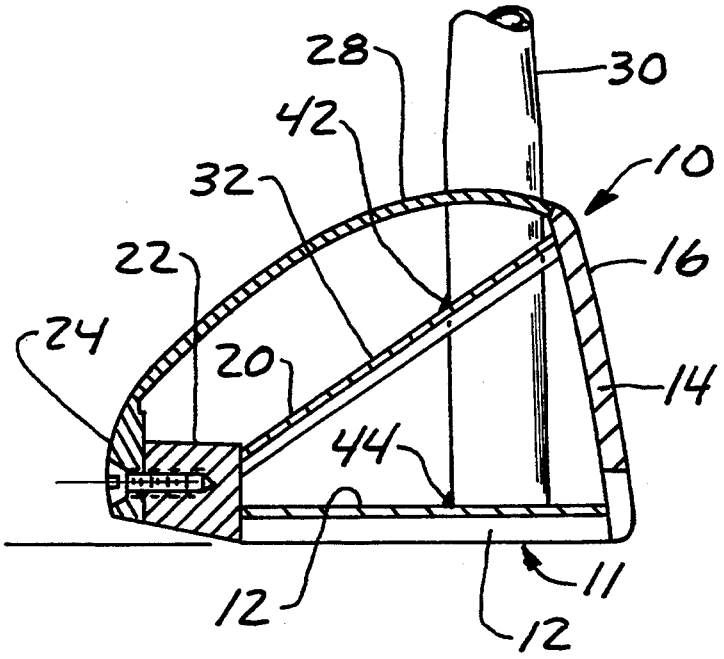
FIG. 2 is a sectional view taken on lines 2—2 in FIG. 1.

A golf club head of one of the preferred embodiments of the present invention is shown generally at 10 and includes a housing 11 comprising a sole plate 12 and a face plate 14 which has a strike face 16 which strikes a golf ball during a club swing. The housing 11 further includes a shell wall 20 that is fixed to the face plate at its rear surface and which will be more fully explained. The shell wall 20 extends rearwardly from the face plate and is attached to a mass or block 22 which is at the trailing or rear end of the head 10. A rear wall 24 is attached to the mass 22 and may be used to support an outer cover 28. A neck or hosel 30 is supported on the shell wall and sole plate and the club shaft 31 attaches to the neck or hosel 30.

The face plate 14 is structurally connected to the mass 22 at the rear of the club head by the shell wall 20 and the sole plate 12, which together form a shell structure 40. The shell wall 20 as shown is a generally conical wall that is enclosed by the sole plate 12 to form the shell structure 40. The shell wall 20, as shown, includes a top wall element 32, and first, second and third wall elements 34, 36, and 38 respectively. The shell wall elements and the sole plate 12 are joined to each other where they abut and their end edges are joined to face plate 14 and rear mass 22, respectively, by silver solder, brazing, welding, or when some other materials of construction are used, by gluing to make a rigid assembly.

It would be possible to make the shell wall elements and the sole plate of a single sheet to reduce the amount of edge joining needed. Alternately, the components of the shell structure 40 may be cast or otherwise formed in two or more units and joined.

The overall mass which is saved by virtue of the light weight shell structure is concentrated low and toward the rear in the mass block 22 which is solid block of material. If desired, the shell walls, sole plate and face plate could be more massive and mass block 22 could be eliminated. In such case, the rear of the housing structure could terminate in a point, or in an open rear end, or in a rounded and closed rear end much like prior art club heads.

Figure 4:
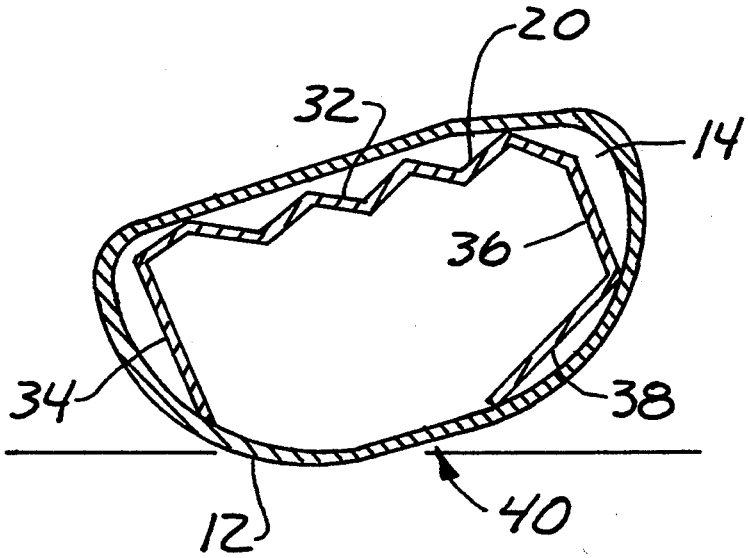
FIG. 4 is a sectional view taken on line 4—4 in FIG. 3 but with an outer cover removed.
Figure 5:
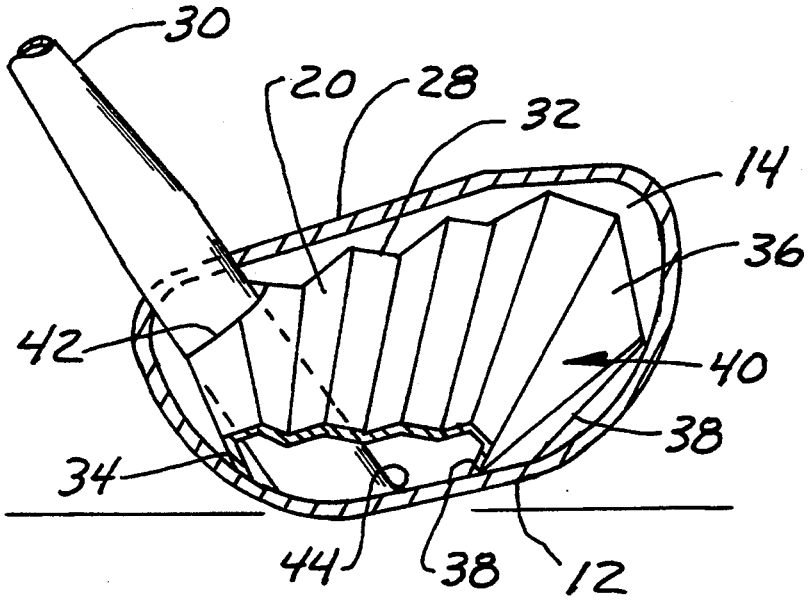
FIG. 5 is a sectional view taken on line 5—5 in FIG. 3 but with an outer cover removed.

FIGS. 4 and 5 illustrate the generally conical shape for the shell structure 40, comparing shell wall 20 and sole plate 12, and illustrate that the shell structure is not like a cone having the usual circular cross section. The shell structure conical shape has non-circular cross sections. These cross sections are not of geometrically similar shape. When made of metal, the shell structure can be bent to shape from a flat piece with little or no stretching of metal required.

Figure 6:
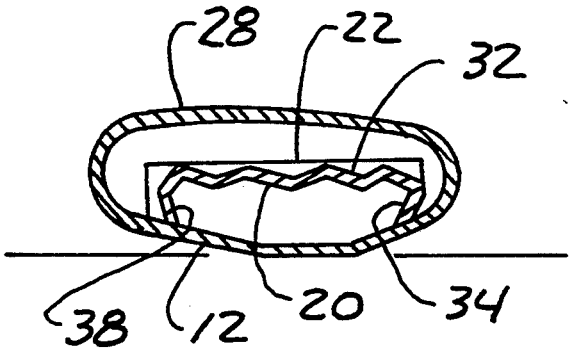
FIG. 6 is a sectional view taken on line 6—6 in FIG. 3 but with an outer cover removed

It is desirable for the shell wall 20 elements to be corrugated, as shown for shell wall element 32, with the long axis of the corrugations roughly aligned with the direction between the front and rear edges of each element. The long axis or lengths of the corrugations thus lie along straight lines that are in planes generally perpendicular to the strike face. This is best seen in FIGS. 4, 5, and 6. The purpose is to improve the compressive strength of the shell wall elements and the entire shell structure for the loads the shell structure must bear during ball impact on the front face 16 of the face plate 14.

Figure 3:
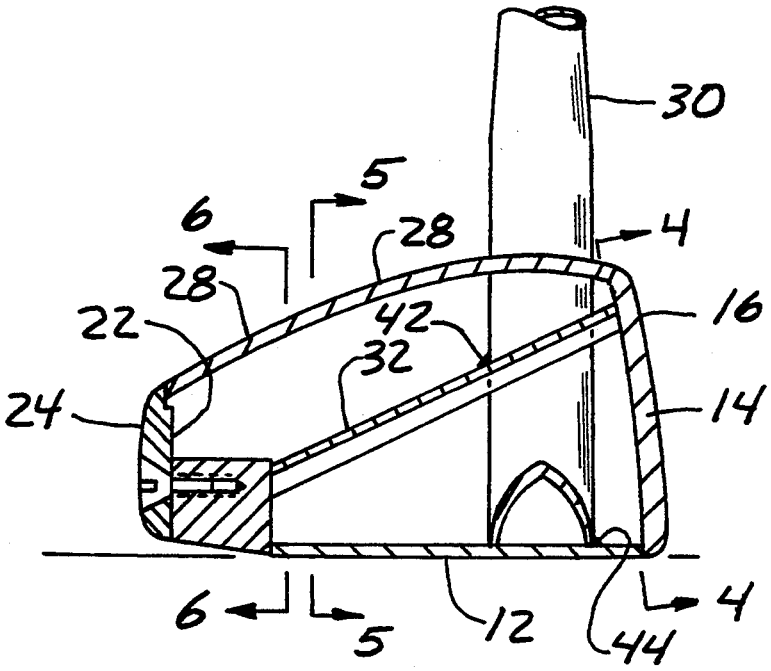
FIG. 3 is a sectional view taken on line 3—3 in FIG. 1.

Shaft 31, shown in FIG. 1, is suitably joined to neck or hosel 30. Neck 30 is joined to the shell structure including shell wall element 32 and if desired other shell wall elements, and the sole plate 12 by welding, brazing or glue as desired. One such joint is at 42 in the upper part of the shell structure and another is shown at 44 on the top of the sole plate 12. The neck or hosel 30 may end at the sole plate and/or lower portions of the shell wall, as shown for example in FIG. 3, or may extend through the sole plate, as desired.

This internal shell structure, which is the main support for the face plate, is covered if preferred, by cover 28, which is held rigidly in place by being clamped between the outer edge of rear wall 24 and the outer edge of face plate 14, and the cover may additionally be bonded to the supporting wall and plates, if desired.

It is highly desirable that cover 28 be rigid and be rigidly joined to the rest of the housing components of the head. If the cover 28 is made of material that is somewhat soft and compliant, it will not contribute as much of its kinetic energy to the ball during impact as does a rigid cover. Reduction in rigidity reduces the velocity of the ball for a given impact or swing. Sheet metal or fiber-reinforced plastic such as graphite fiber-reinforced plastic currently available are good material choices. The space inside this cover may be filled with foam if desired.

Figure 8:
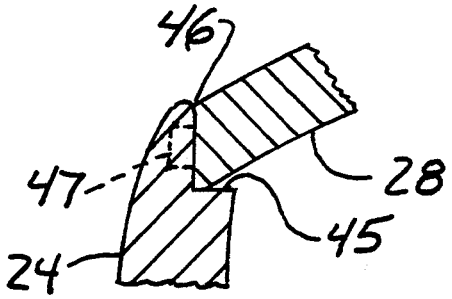
FIG. 8 is an enlarged fragmentary view showing a typical junction between a cover and a rear wall of a golf club head.

An enlarged detail of the junction of the cover 28 and the rear wall or plate 24 is shown in FIG. 8. This showing represents typical joining techniques for both the front and rear edges of the cover. A shoulder 45 is provided to receive the edge of the cover 28 to make the fit easier to make with a smooth appearance and to hide minor imperfections of shape of cover 28 or rear wall 24. A reasonably close fit between cover 12 and rear wall 24 is shown at 46 and serves to position these two parts relative to each other. In addition or alternately, a tongue and groove construction may be used on portions of the joining edges, as shown in dotted lines at 47, for alignment purposes. An alternative for the curved shell construction of cover 28 is to make it of reasonably rigid and light weight foam material.

Figure 7:
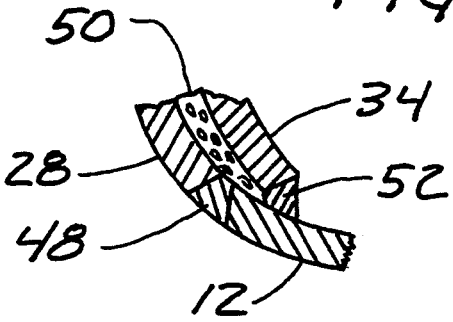
FIG. 7 is an enlarged fragmentary view showing a detail of a modified form of the invention for joining a cover to a shell structure.

Another enlarged detail of cover 28 and its junction to the shell structure, which are of a modified form is shown in FIG. 7. The modified enlarged section differs from the previous embodiment and includes an adhesive filler shown at 48, which may preferably be of rubber-like character. An optional foam filling between cover 28 and the shell structure comprising shell wall 20 and sole plate 12 is illustrated at 50. A solder or weld joint or other means to join shell wall element 34 (or 40) to the sole plate 12 is shown at 52.

The edge joint for cover 28 which is shown in FIG. 7 has little structural loading during impact. Accordingly, one simple design is to make it as an open joint and fill the intervening space as needed with filler material 48. This accommodates minor dimensional variations. Foam 50 may be used between cover 28 and the shell structure.

Figure 9:
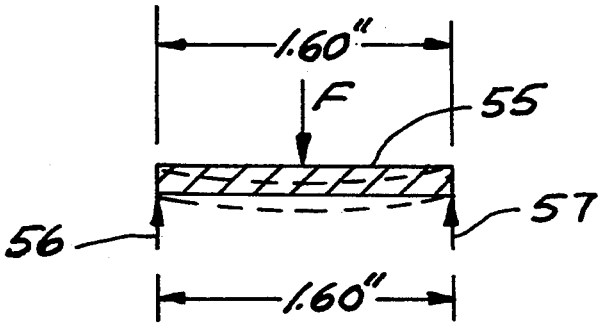
FIG. 9 is a schematic representation showing a simplified approximation to the load, deflection, and stress on the face of a golf club of ordinary design.
Figure 10:
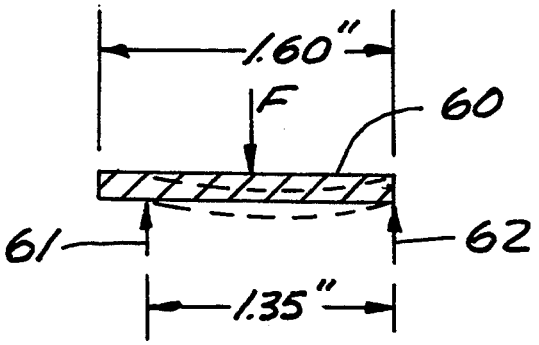
FIG. 10 is a schematic representation showing a simplified approximation to the load, deflection, and stress on the face of a golf club of the present invention.

An idea of the improvement in strength and rigidity made possible by the present invention can be obtained from the schematic showings in FIGS. 9 and 10. In FIG. 9, a simplified schematic model is shown for the strike face. The strike face is represented as a flat surface 55. This surface is the surface that strikes the ball. The top and bottom edges of the face plate of a metal wood face, representing the height of the strike face, are typically 1.60 inch apart as shown. The conventional outer shell of a club head is much thinner than the face plate and is attached at the outer edge of the face plate. The model is simply showing supports 56 at the top edge of the face plate and 57 at the bottom edge, since the bending stiffness of the outer shell in a conventional club is low. The force of impact of a golf ball is approximated as a concentrated force F as shown.

FIG. 10 shows the same simplified model but illustrating the present invention at 60. For this purpose, it is assumed that the top part of the conical shell structure illustrated at 20 is attached at 61, 0.25 inch (about 16%) below the upper edge of the face plate (and strike face) as generally shown in FIGS. 4 and 5. Because the sole plate 12 should rest on the grass, it is assumed the lower attachment of the shell structure as represented by the sole plate 12 is at the lower edge of the face plate represented at 62, although the shell structure could be attached somewhat inward from the edge as is done at the top and ends.

For these two simplified models, it is easy to calculate the deflection for each case and compare it. It is found that for FIG. 10, the deflection is only 60.1% of the deflection for FIG. 9. Stress is also easy to calculate. We find that the bending stress in the face for FIG. 10 is only 71.2% of the bending stress of FIG. 9.

The shell wall 20 is preferably inboard from the edge of the strike face at least 0.15 inch or at least about 10% of the height of the strike face. The preferred arrangement is to have more than one-half of the peripheral length of the entire shell structure spaced inwardly at least 10% of the supported maximum height of the strike face. A preferred portion is in about 16% of the height which is illustrated in FIG. 10. The effective limit of inward spacing of the edge is about 20% of the face height. In the real case, it is expected the comparison would be more favorable toward the present invention. One reason is that the force of the ball is spread over a circular area 0.75 to 1 inch in diameter rather that at a single point. This is a much larger portion of the space between supports for FIG. 10 than for FIG. 9, causing less deflection and stress for the FIG. 10 arrangement. Another reason is that the conventional shell is curved and will therefore bulge outward more during impact and add significantly to the deflection. The conical shell of the present invention is far more rigid for such loads and adds little to the deflection.

The mass block 22 is usually made of metal or some other dense material. The neck or shaft attachment element is fixed to the shell structure rigidly so the rigidity of the shell structure is fully effective in imparting to the ball a maximum fraction of the energy put in to the swing by the golfer holding the shaft.

Although the present invention has been described with reference to preferred embodiments, workers skilled in the art will recognize that changes may be made in form and detail without departing from the spirit and scope of the invention.

What is claimed is:

1. A golf club head comprising a face plate having a strike face, a structural support comprising a shell structure circumscribing an interior space, and having a first end and a second end, the first end of the shell structure being joined to a side of the face plate opposite from the strike face near the perimeter of the strike face, the shell structure having a cross sectional shape approximating the shape of the perimeter of the strike face, the second end of said shell structure terminating at a location spaced from the face plate in a direction extending away from the strike face, and an element for attaching a shaft joined to the shell structure.

2. The golf head of claim 1 wherein the shell structure tapers from the first end to a smaller cross section second end along substantially straight lines in the direction of taper.

3. The golf club head as claimed in claim 2 wherein the shell structure comprises a generally conical shape having at least one wall portion corrugated in cross section.

4. The golf club head of claim 3 in which the second end, said generally conically shaped shell structure carries a mass.

5. The golf club head of claim 1 wherein said element for attaching the shaft penetrates an upper wall of said shell structure and is joined to the upper wall of the shell structure and wherein the element for attaching a shaft is also joined to a lower surface of said shell structure.

6. The golf club head of claim 1, further comprising an outer cover of desired shape extending from the perimeter of said face plate and surrounding and enclosing at least part of said shell structure and terminating to be substantially coextensive with the shell structure.

7. The golf club head of claim 4, further comprising an outer cover of desired shape mounted on and extending in a direction away from the strike face so as to surround and enclose at least part of said shell structure, and terminating proximate said mass.

8. The golf club head of claim 1 in which said face plate and said shell structure are made of metal.

9. The golf club head of claim 1 in which said face plate and said shell structure are made of fiber-reinforced plastic.

10. The golf club head of claim 4 in which said face plate and said shell structure are made of fiber-reinforced plastic and said mass is made of metal.

11. The golf club head of claim 1 in which said shell structure includes a shell wall, and wherein the shell wall includes a top wall that is corrugated, the corrugations having longitudinal lengths running in the direction from the second end of said shell structure toward the face plate.

12. The golf club head of claim 11 and a mass block attached to the second end of the shell structure.

13. The golf club head of claim 12 wherein the shell structure has a bottom wall forming a sole plate for the golf club head, the sole plate having a lower surface that is an exterior surface of the golf club head.

14. The golf club head of claim 1 wherein the shell structure has a peripheral edge length where the first end is joined to the face plate, and at least one-half of the length of the peripheral edge is spaced more than 10% of a generally vertical height of the face plate inwardly from a peripheral edge of the face plate.

15. A golf club head shell comprising a face plate having a strike face, a shell structure of thin material formed around an axis extending in direction away from the strike face on a opposite side of the face plate from the strike face and circumscribing an interior space surrounded by the shell structure, a first end of the shell structure being joined to a side of the face plate opposite from the strike face near the perimeter of the strike face, the first end of the shell structure having a cross sectional shape approximating the shape of the perimeter of the strike face, a second end of said shell structure having a smaller cross section than the first end and terminating at a location spaced from the face plate in direction extending away from the strike face, and a mass block attached rigidly to the second end.

16. The golf club head shell of claim 15 wherein the shell has a peripheral edge length where the first end is joined to the face plate, and at least one-half of the length of the peripheral edge is spaced more than 10% of a generally vertical height of the face plate inwardly from a peripheral edge of the face plate.

17. The golf club head shell of claim 15 wherein the shell structure tapers from the first end to the smaller cross section second end along substantially straight lines in the direction of taper.

18. The golf club head shell as claimed in claim 17 wherein the shell structure comprises a generally conical shape having at least one wall portion corrugated in cross section.

19. The golf club head shell as claimed in claim 15 wherein the shell structure has a top wall and a bottom wall and side wall elements joining the top and bottom walls, the bottom wall forming an exterior sole plate of a golf club head, and the top wall tapering toward the bottom wall in direction toward the second end.

20. The golf club head shell of claim 19 wherein the top wall is corrugated in direction to stiffen the top wall against deflection when loaded from a force on the strike face when the strike face impacts a golf ball.

* * * * *

UNITED STATES PATENT AND TRADEMARK OFFICE

CERTIFICATE OF CORRECTION

PATENT NO. : 5,380,010

DATED : January 10, 1995

INVENTOR(S) : Frank D. Werner and Richard C. Greig

It is certified that error appears in the above-indentified patent and that said Letters Patent is hereby corrected as shown below:

Column 6, line 57, after "which" insert --at--.

Signed and Sealed this

Thirtieth Day of May, 1995

*Attest:*

Bruce Lehman

BRUCE LEHMAN

*Attesting Officer*

*Commissioner of Patents and Trademarks*